US005983061A

United States Patent [19]

Matsuzoe et al.

[11] Patent Number: 5,983,061

[45] Date of Patent: Nov. 9, 1999

[54] IMAGE FORMING APPARATUS WITH REDUCED FLEXURAL DEFORMATION OF ENDLESS BELT

[75] Inventors: Hisanobu Matsuzoe, Chikushino; Kouji Migita, Fukuoka-ken; Shinichi Kizu, Fukuoka; Yusuke Shiibara, Kasuga; Yasunori Sagara, Kasuga; Masashi Ogawa, Kasuga; Yukinori Hara, Fukuoka-ken, all of Japan

[73] Assignee: Matsushita Electric Industrial Co., Ltd., Osaka, Japan

[21] Appl. No.: 09/097,686

[22] Filed: Jun. 16, 1998

[30] Foreign Application Priority Data

Jul. 2, 1997 [JP] Japan ..... 9-176722

[51] Int. Cl.[6] ..... G03G 15/16

[52] U.S. Cl. ..... 399/297

[58] Field of Search ..... 399/162, 164, 399/165, 297, 222, 237, 252

[56] References Cited

U.S. PATENT DOCUMENTS 5,216,453 6/1993 Itoh ..... 399/297

5,737,669 4/1998 Ring ..... 399/162

5,819,133 10/1998 Matsuzoe et al. ..... 399/297

FOREIGN PATENT DOCUMENTS 469254 3/1992 Japan .

8314291 11/1996 Japan .

*Primary Examiner*—Matthew S. Smith

*Assistant Examiner*—William A. Noe

*Attorney, Agent, or Firm*—Stevens, Davis, Miller & Mosher, L.L.P.

[57] ABSTRACT

A toner image onto a print form by pressing a photosensitive material belt against a transfer plate through movement of a transfer opposite roller. The photosensitive material belt running in a direction orthogonal to the supply direction of the print form on a transfer plate. The photosensitive material belt is stably maintained at a region completed for transfer in an attitude following the upper surface of the print form.

4 Claims, 3 Drawing Sheets

IMAGE FORMING APPARATUS WITH REDUCED FLEXURAL DEFORMATION OF ENDLESS BELT

BACKGROUND OF THE INVENTION

1. Field of the Invention

The present invention relates to an electronic photographic image forming apparatus, and, more particularly, to an orthogonal transfer type image forming apparatus where a toner image carried by a toner image carrier belt is transferred in a direction orthogonal to the transporting direction of a print form.

2. Description of the Prior Art

Recently, image forming systems increasingly use toner as represented by a laser printer which can produce a clear image with a higher resolution.

FIG. 3 is a schematic view showing an arrangement of a conventional image forming apparatus; FIG. 4 is a perspective view showing transfer and transporting processes in the conventional image forming apparatus; and FIG. 5 is a schematic view showing the transfer process through movement of a transfer opposite roller in the conventional image forming apparatus.

As shown in FIGS. 3 and 4, a photosensitive material belt 1 is resiliently deformable, coated with an organic photoconductive material on its surface, and wound in a loop around a support roller 9*a*, a displacing roller 9*b*, and the transfer opposite roller 8 to be capable of running in the direction of the arrows in the figure. The transfer opposite roller 8 is arranged to be movable on a plane at the same level with respect to a transfer plate 10, and to rotate by itself.

Arranged in the running direction of the photosensitive material belt 1 are a cleaning unit 4 for removing residual toner after transfer, a discharging unit 5 for discharging residual charges after transfer, a charging unit 2 for uniformly charging the photosensitive material belt 1 to negative potential for preparation to transfer, an exposure unit 6 for forming an electrostatic latent image on the surface of the photosensitive material belt 1 by projecting exposure light 6*a* such as a laser beam, and a developer unit 3 containing toner 3*a* therein in this order. In addition a print form 7 is fed onto the transfer plate 10 by a sheet feed roller (not shown) disposed in a path at the insertion end of the transfer plate 10, and is fed out to a fixing unit 15 by a sheet discharge roller (not shown) disposed in a path at the discharge end after transfer.

Here, as the exposure unit 6, a type using an LED or LCD for projecting light has been employed in place of exposure light 6*a* using a laser. In addition, the fixing unit 15 is a non-contact type comprising a heat source 12, a reflector plate 13 and a transport plate 14, thereby heating and fixing a toner image on the print form 7.

The loop of the photosensitive material belt 1 is, as shown in FIG. 3, in a direction orthogonal to the path in which print form 7 is supplied from the upstream and fed toward the fixing unit 15, so that the running direction of the photosensitive material belt 1 is in a relationship orthogonal to the supply direction of print form 7. Then, at a time of forming an image, the toner image 3*c* is formed on the surface of the toner image carrier belt 1 in accordance with movement of the photosensitive material belt 1 in the direction of the arrows.

In such an orthogonal transfer system, the transfer of a toner image 3*c* to the print form 7 is performed by stopping the running of the photosensitive material belt 1 and the transportation of the print form 7, then moving the transfer opposite roller 8 in the direction of the arrow in FIG. 5 along the transfer plate 10 while rotating it with respect to the print form 7 held stationary on the transfer plate 10. This movement of the transfer opposite roller 8 causes sequential deformation of the photosensitive material belt 1 as shown in the figure, so that its surface rubs the print form 7. As the photosensitive material belt 1 is deformed, the displacing roller 9*b* also moves from its initial position indicated by a broken line in the figure to a position indicated by a solid line. Accordingly, such movement of the displacing roller 9*b* prevents the photosensitive material belt 1 from being unnecessarily loosened.

In such transfer by the movement of the transfer opposite roller 8 and the deformation of the photosensitive material belt 1, the transfer opposite roller 8 passes over the print form 7 and moves outside the print form 7 every time one transfer process is completed. That is, as shown in FIG. 3, when the transfer opposite roller 8 is positioned outside the print form 7 from its left edge, the photosensitive material belt 1 is in a state where it is not in contact with the print form 7. Under such state, the print form 7 is fed. The amount of feed for the print form 7 at the moment is equal to the effective transfer width of the photosensitive material belt 1. Therefore, transfer is repeated for one sheet of print form 7 by intermittently feeding the print form 7, and sequentially forming toner images 3*c* on the photosensitive material belt 1.

Incidentally, when the transfer opposite roller 8 shown in FIG. 3 moves from the initial position to the right as shown in FIG. 4 through rotation, the displacing roller 9*b* disposed in the advancing direction of the transfer opposite roller 8 is freely displaced from its position under a load from deformation of the photosensitive material belt 1.

Therefore, tension by the transfer opposite roller 8 and the displacing roller 9*b* is maintained substantially constant for the photosensitive material belt 1 positioned between the transfer opposite roller 8 and the displacing roller 9*b*.

On the other hand, there is no compensation function for tension against the movement of the transfer opposite roller 8 for the photosensitive material belt 1 positioned between the transfer opposite roller 8 and the support roller 9*a* because the support roller 9*a* is fixed in position. Thus, there arises insufficient tension on the photosensitive material belt 1 between the support roller 9*a* and the transfer opposite roller 8, so that downward flexural deformation D would be generated as shown in FIG. 5.

Once such flexural deformation D is generated, the photosensitive material belt 1 may have minute flexure or tend to contact with the print form 7 due to the downward load from the flexural deformation D at a section immediately after the photosensitive material belt 1 passes through a nip between the transfer opposite roller 8 and the print form 7. Therefore, there is a possibility that the photosensitive material belt 1 at the position immediately after the nip contacts with a toner image 3*d* immediately after printing on the print form 7 to disturb the printing toner.

In addition, when the flexural deformation D is generated in the photosensitive material belt 1 immediately after the nip, the effect of flexural deformation D also extends to the nip, so that defective printing may be caused as a proper nip pressure cannot be maintained.

As described, since the conventional orthogonal transfer type image forming apparatus causes flexural deformation in the photosensitive material belt as the transfer opposite roller moves, there is a problem that disturbance is caused in a printed image.

SUMMARY OF THE INVENTION

An object of the present invention is to solve the above problem in the prior art, and the invention is intended to provide an image forming apparatus allowing transfer free from disturbance in an image in such a manner that the photosensitive material belt is arranged to be maintained in a stable contact with a print form from beginning to ending of a transfer process.

To attain the above object, in accordance with the present invention, there is provided an image forming apparatus for transferring a toner image carried on an endless toner image carrier belt, which is stretched by a plurality of rollers in a direction orthogonal to a transporting direction of a print form, onto the print form by a transfer opposite roller, which is mounted inside the toner image carrier belt and reciprocates in a direction orthogonal to a transporting direction of the print form along the support plate for supporting a print form, wherein the toner image carrier belt is closely contacted to the print form by movement of the transfer opposite roller, whereby the toner image carrier belt pressed against the print form by the transfer opposite roller can hold stable and stationary a transferred section on the print form.

DESCRIPTION OF THE PREFERRED EMBODIMENTS

Figure 3:
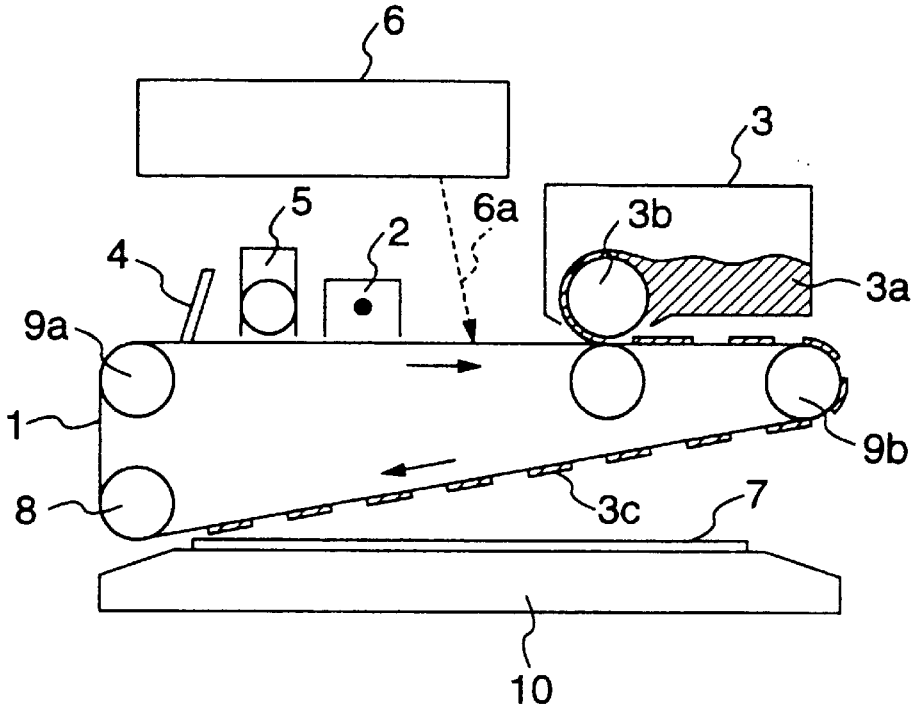
FIG. 3 PRIOR ART
FIG. 3 is a schematic view of a conventional image forming apparatus.
Figure 4:
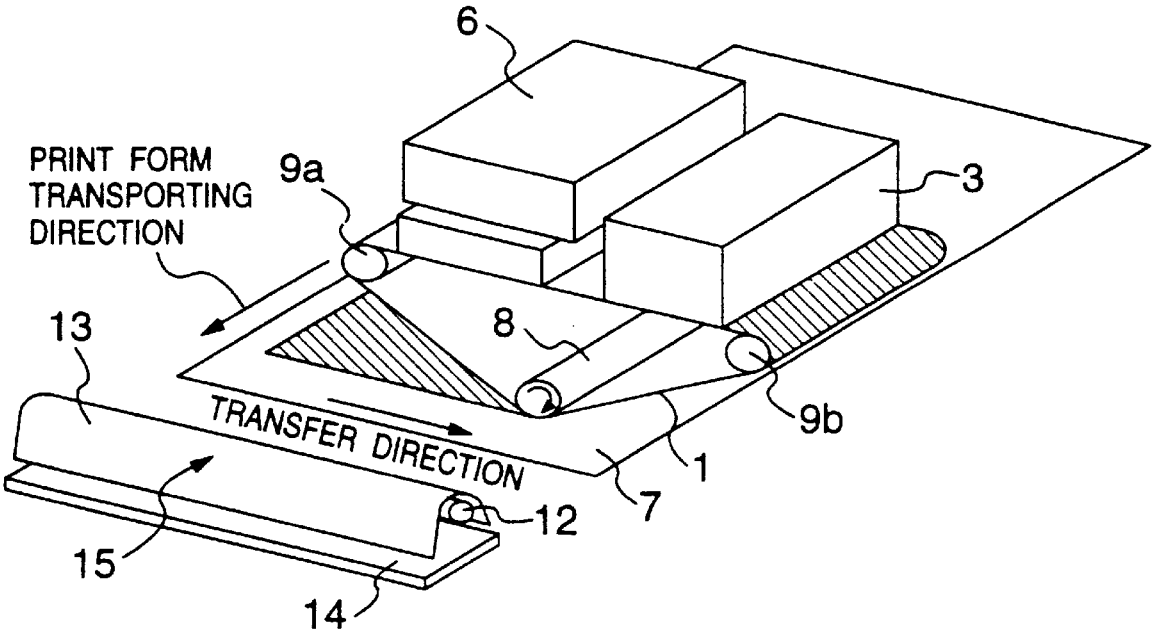
FIG. 4 PRIOR ART
FIG. 4 is a perspective view of transfer and transportation processes in the conventional image forming apparatus.
Figure 5:
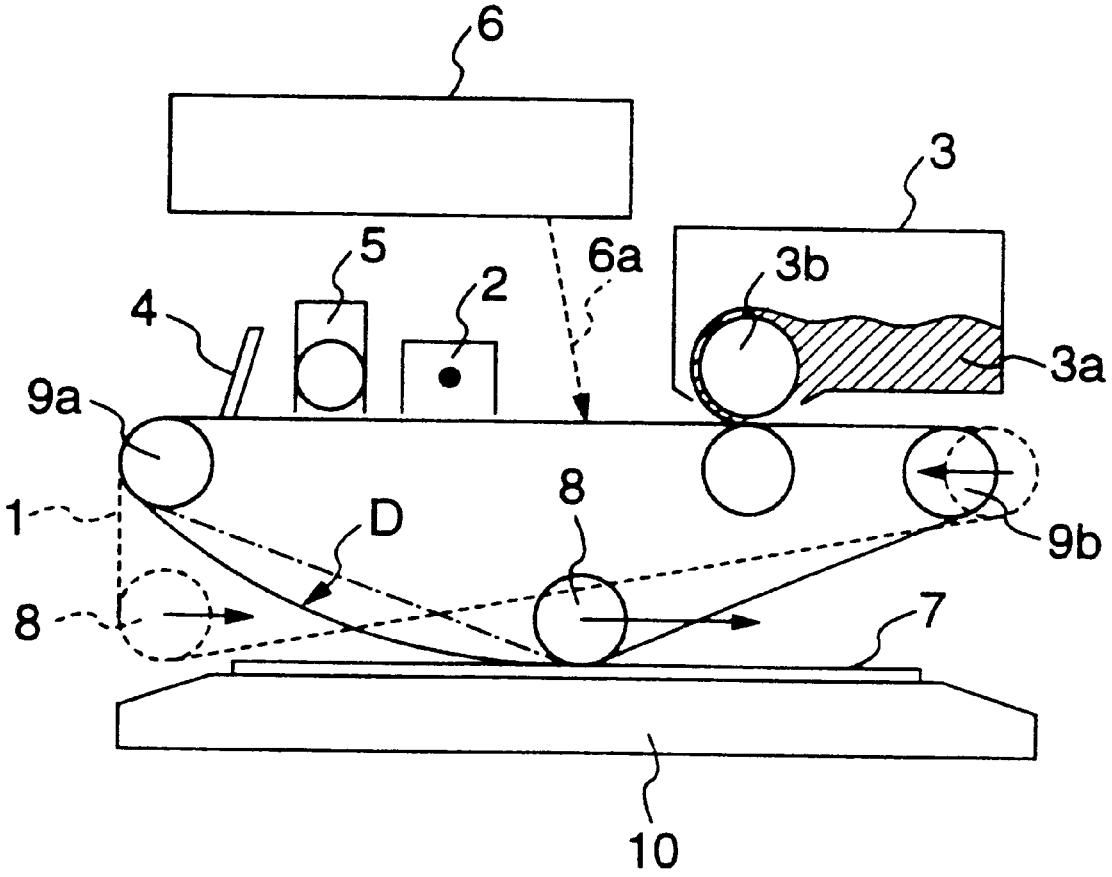
PRIOR ART FIG. 5
FIG. 5 is a schematic view showing the transfer process by movement of a transfer opposite roller in the conventional image forming apparatus.

An embodiment of the present invention will be described with reference to FIGS. 1 and 2 below. The same reference numerals are attached to the same components as those of the prior art shown in FIGS. 3 through 5.

Figure 1:
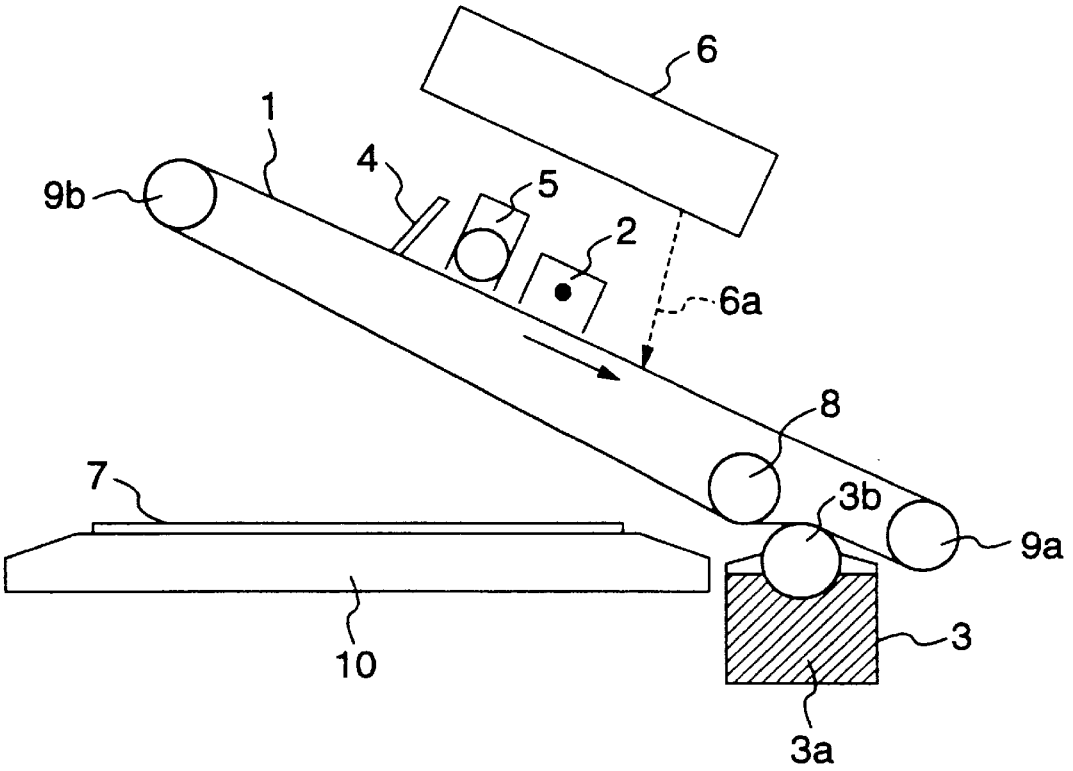
FIG. 1 is an image forming apparatus according to an embodiment of the present invention.
Figure 2:
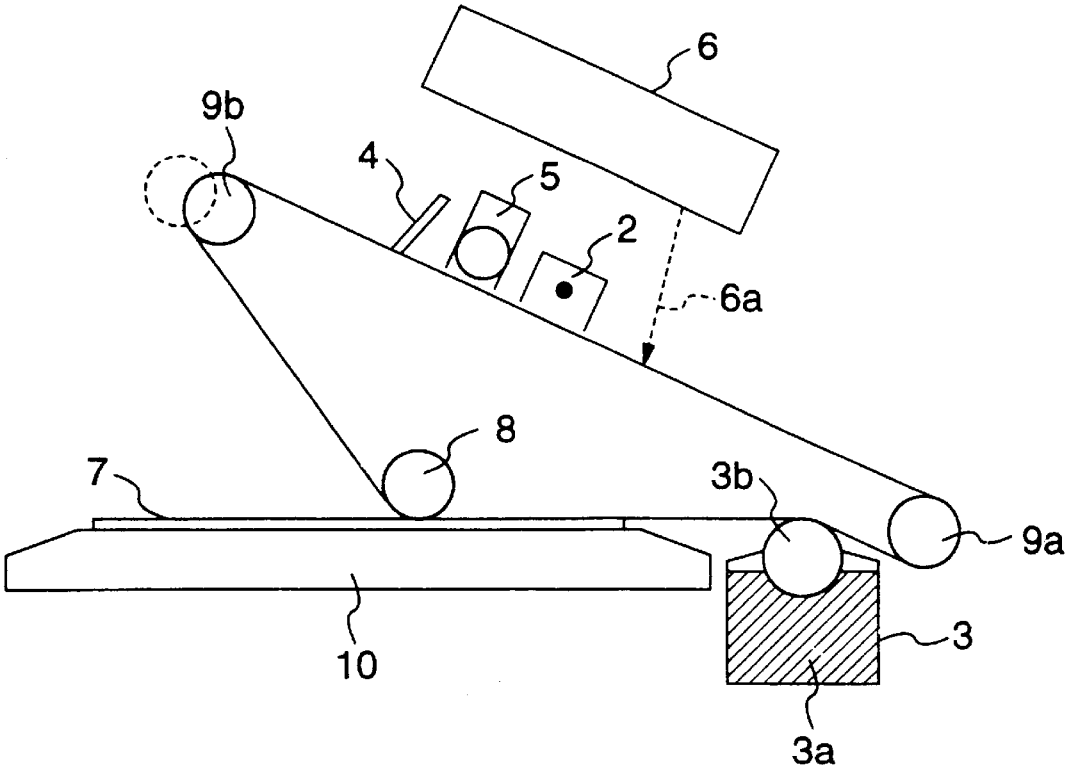
FIG. 2 is an intermediate step in a transfer process of the image forming apparatus according to the embodiment of the present invention.

FIG. 1 is an image forming apparatus according to an embodiment of the present invention; and FIG. 2 is an intermediate step in a transfer process of the image forming apparatus according to the embodiment of the present invention.

Referring to FIG. 1, in the same manner as in the prior art, a resiliently deformable photosensitive material belt 1 is wound in a loop provide a toner image carrier wound around a support roller 9*a*, a displacing roller 9*b*, and a transfer opposite roller 8. Belt is arranged to be capable of running in the direction of the arrow in FIG. 1. Then, a print form 7 is supplied onto a transfer plate 10 in a direction perpendicular to the surface of the figure, and the photosensitive material belt 1 is in such a relationship that it runs in a direction orthogonal to the supply direction of the print form 7.

The support roller 9*a* is arranged with its position being secured at the right side of the transfer plate 10. The displacing roller 9*b* has its stationary position above the left side of the transfer plate 10, and can move in a range of a certain stroke from the stationary position toward the support roller 9*a*. The transfer opposite roller 8 is arranged to be capable of reciprocating on a plane at the same level with respect to the transfer plate 10 in a horizontal direction in the figure and rotating by itself.

In addition, disposed around the loop of the photosensitive material belt 1 are a cleaning unit 4, a discharging unit 5, a charging unit 2, and an exposure unit 6 for projecting exposure light 6*a*, all of which function are the same as those of the prior art. Then, the developer unit 3 differs from the prior art in that it is disposed at the right side of the transfer plate 10 and at a location opposite to the path of the photosensitive material belt 1 from the support roller 9*a* to the transfer plate 10.

The developer unit 3 rotatably supports a developer roller 3*b* for attaching toner 3*a* contained in the developer unit 3 onto an electrostatic latent image on the photosensitive material belt 1. The upper periphery of the developer roller 3*b* is established to be at the same level as, or slightly above the upper surface of transfer plate 10. That is, as shown in FIG. 2, when the transfer opposite roller 8 moves from its initial position toward the transfer plate 10, it is arranged that the transfer opposite roller 8 holds the print form 7 between it and the transfer plate 10, and that the photosensitive material belt 1 is deformed to be parallel to the upper surface of the transfer plate 10 from the location contacting with the periphery of the developer roller 3*b*.

With the above arrangement, when the photosensitive material belt 1 runs in the direction orthogonal to the transporting direction of the print form 7, the region passing through the charging unit 2 is uniformly charged to about −600 V, and potential is raised to about −100 V at a region irradiated by the exposure light 6*a* from the exposure unit 6 on the basis of an image signal to form an electrostatic latent image. Then, a toner image is formed on the photosensitive material belt 1 by pressing toner 3*a* onto the region formed with the electrostatic latent image by means of the developer roller 3*b*.

When the region of the photosensitive material belt 1 formed with the toner image is positioned at a position corresponding to the upper surface of the transfer plate 10, running of the photosensitive material belt 1 is stopped together with the print form 7 held stationary on the transfer plate 10. Then, as shown in FIG. 1, the transfer opposite roller 8 at the initial position at the right side of the transfer plate 10 is moved to the left while rotating it counterclockwise in the figure. This movement of the transfer opposite roller 8 causes the photosensitive material belt 1 to transfer the toner image onto the print form 7 while gradually covering the print form 7 on the transfer plate 10 as shown in FIG. 2.

When the transfer opposite roller 8 moves toward the transfer plate 10 on the print form 7 in the direction orthogonal to the supply direction of the print form 7, the displacing roller 9*b* is displaced from its initial position indicated by the broken line to a position indicated by the solid line, as shown in FIG. 2, following the deformation of the photosensitive material belt 1. Accordingly, the photosensitive material belt 1 positioned between the transfer opposite roller 8 and the displacing roller 9*b* is maintained at a proper tension as in the prior art, and does not cause flexural deformation.

On the other hand, the photosensitive material belt 1 disposed between the transfer opposite roller 8 and the developer roller 3*b* has a longer distance to more to cover the print form 7 as the transfer opposite roller 8 moves. The photosensitive material belt 1 covers the print form 7 on the transfer plate 10 to closely contact with the print form 7 at substantially the same level as the starting point on the upper end periphery of the developer roller 3*b*. Therefore, the photosensitive material belt 1 is held in a planar manner following the transfer plate 10 or the print form 7 thereon without flexural deformation, the photosensitive material belt 1 being between the transfer opposite roller 8 and the developer roller 3*b*, and having already transferred the toner image thereon onto the print form 7.

As such, the photosensitive material belt 1 does not have flexural deformation after the transfer opposite roller 8 passes over, and is held in a stable attitude with respect to the print form 7, so that there is no possibility that the surface of the photosensitive material belt 1 unnecessarily contacts with the toner image transferred onto the print form 7 to disturb the image.

Although in the above embodiments the developer roller 3*b* of the developer unit 3 is made such as to function as an auxiliary roller for holding the photosensitive material belt 1 in a stable attitude with respect to the print form 7 without flexural deformation after the transfer opposite roller 8 passes over, it may be possible to incorporate an idler type roller as the auxiliary roller in the same arrangement as the developer roller 3*b* in FIGS. 1 and 2.

We claim:

1. An image forming apparatus, comprising:

a support plate for a print form;

an endless carrier belt for carrying a toner image; and a plurality of rollers for stretching said belt in a direction orthogonal to a transporting direction of said print form along said support plate and including a transfer opposite roller for causing transfer of said toner image from said belt to said print form, said transfer opposite roller being mounted inside a loop formed by said belt and being reciprocable within a range of movement in a direction orthogonal to said transporting direction, wherein one of said plurality of rollers is mounted outside said range of movement of said transfer opposite roller, wherein a subset of said plurality of rollers is mounted inside said loop formed by said belt, said subset excluding said one of said rollers, and wherein said one of said rollers has a peripheral portion disposed in substantially a same plane as a print form supporting surface of said support plate.

2. An apparatus as claimed in claim 1, further comprising a toner applying means for applying said toner image to said belt, and wherein as said transfer opposite roller is moved in a first direction within said range of movement, said transfer opposite roller gradually urges an image carrying part of said belt toward said print form to cause said toner image to be gradually transferred from said belt to said print form while said transfer opposite roller and said one of said rollers cause portions of said image carrying part of said belt already urged by said transfer opposite roller toward said print form to be oriented in a plane substantially parallel to said print form supporting surface of said support plate.

3. An image forming apparatus comprising:

a support plate for a print form;

an endless carrier belt;

a toner roller for attaching toner on said endless carrier belt to form a toner image thereon; and a plurality of rollers for stretching said belt in a direction orthogonal to a transporting direction of said print form along said support plate and including a transfer opposite roller for causing said toner image carried on said belt to be transferred onto the print form, said transfer opposite roller being mounted inside a loop formed by said carrier belt and being reciprocable within a range of movement in a direction orthogonal to said transporting direction, wherein said toner roller is mounted outside said range of movement of said transfer opposite roller, and wherein said toner roller has a peripheral portion disposed in substantially a same plane as a print form supporting surface of said support plate.

4. An apparatus as claimed in claim 3, wherein as said transfer opposite roller is moved in a first direction within said range of movement, said transfer opposite roller gradually urges an image carrying part of said belt toward said print form to cause said toner image to be gradually transferred from said belt to said print form while said transfer opposite roller and said toner roller cause portions of said image carrying part of said belt already urged by said transfer opposite roller toward said print form to be oriented in a plane substantially parallel to said print form supporting surface of said support plate.

* * * * *